US007413224B2

(12) United States Patent
Graute

(10) Patent No.: US 7,413,224 B2
(45) Date of Patent: Aug. 19, 2008

(54) MOTOR VEHICLE DOOR LOCK

(75) Inventor: Ludger Graute, Essen (DE)

(73) Assignee: Kiekert AG, Heiligenhaus (DE)

( * ) Notice: Subject to any disclaimer, the term of this patent is extended or adjusted under 35 U.S.C. 154(b) by 170 days.

(21) Appl. No.: 10/555,376

(22) PCT Filed: Apr. 30, 2004

(86) PCT No.: PCT/DE2004/000911

§ 371 (c)(1),
(2), (4) Date: Nov. 2, 2005

(87) PCT Pub. No.: WO2004/101928

PCT Pub. Date: Nov. 25, 2004

(65) Prior Publication Data

US 2006/0157989 A1 Jul. 20, 2006

(30) Foreign Application Priority Data

May 8, 2003 (DE) ..... 103 20 447

(51) Int. Cl.
*E05C 3/12* (2006.01)

(52) U.S. Cl. ..... 292/216; 292/201; 292/DIG. 23

(58) Field of Classification Search ..... 292/216, 292/201, DIG. 23
See application file for complete search history.

(56) References Cited

U.S. PATENT DOCUMENTS

| | | | | |
|---|---|---|---|---|
| 5,896,767 | A | 4/1999 | Gomi | |
| 5,979,951 | A * | 11/1999 | Shimura | 292/216 |
| 6,378,920 | B1 * | 4/2002 | Ostrowski et al. | 292/216 |
| 6,773,042 | B2 * | 8/2004 | Spurr et al. | 292/216 |
| 6,866,311 | B2 * | 3/2005 | Spurr et al. | 292/216 |

FOREIGN PATENT DOCUMENTS

| | | | |
|---|---|---|---|
| DE | 23 40 301 | A1 | 2/1975 |
| DE | 92 10 719 | U1 | 1/1993 |
| EP | 0 743 413 | A1 | 11/1996 |
| EP | 0 769 599 | A1 | 4/1997 |
| FR | 2 786 523 | A1 | 6/2000 |
| GB | 2 200 682 | A | 8/1988 |

* cited by examiner

*Primary Examiner*—Patricia Engle
*Assistant Examiner*—Mark Williams
(74) *Attorney, Agent, or Firm*—Matthias Scholl P.C.; Matthias Scholl

(57) ABSTRACT

The object of the present invention is a vehicle door latch, which in its standard design contains a locking mechanism (1, 2) consisting mainly of a catch (1) and pawl (2). In addition, a blocking element (17) for a locking lever (18) is provided, in which the blocking element (17) prevents, when the catch (1) is open, that the locking lever (18) takes up its locking position. According to the invention, the blocking element (17) is a non-slam lock (17) controlled by the catch (1), which with the locking lever (18) in unlocking position, engages into a recess (20) of the locking levers (18) in order to block it.

17 Claims, 3 Drawing Sheets

MOTOR VEHICLE DOOR LOCK

CROSS-REFERENCE TO RELATED APPLICATIONS

This is a National Stage Application of International Patent Application No. PCT/DE 2004/000911, with an international filing date of Apr. 30, 2004, which is based on German Patent Application No. 103 20 447.4, filed May 8, 2003. The contents of both of these specifications are incorporated herein by reference.

BACKGROUND OF THE INVENTION

1. Field of the Invention

The invention refers to a vehicle door latch with a locking mechanism consisting mainly of a catch und pawl and a blocking element for a locking lever, in which the blocking element prevents—when the catch is open—that the locking lever assumes its locking position.—Generally the blocking element ensures that the locking lever remains in its unlocking position when the catch is open or opened.

2. Description of Related Art

In a vehicle door latch of the embodiment described above and according to DE 199 34 128 A1, a special stroke of the internal door handle is required to be able to move a respective central locking lever into its locked position. Patent Application DE 102 40 003, to be considered in accordance with § 3 (2) PatG, also discloses a catch that is combined with a catch lever to form one subassembly.

The overall aim is to achieve that with the door and consequently also the catch open, the respective locking lever cannot assume its locking position as this could also cause the catch to be closed. This in turn would result in the, for example, manually closed vehicle door to strike against the obligatory locking pin, as the catch is no longer open.

The prior embodiments cannot convince in all points, as they require at least costly designs. The invention aims to provide a solution for this.

BRIEF DESCRIPTION OF THE DRAWINGS

Below, the invention is explained in detail with reference to a drawing showing only one embodiment, in which.

BRIEF SUMMARY OF THE INVENTION

Figure 1:
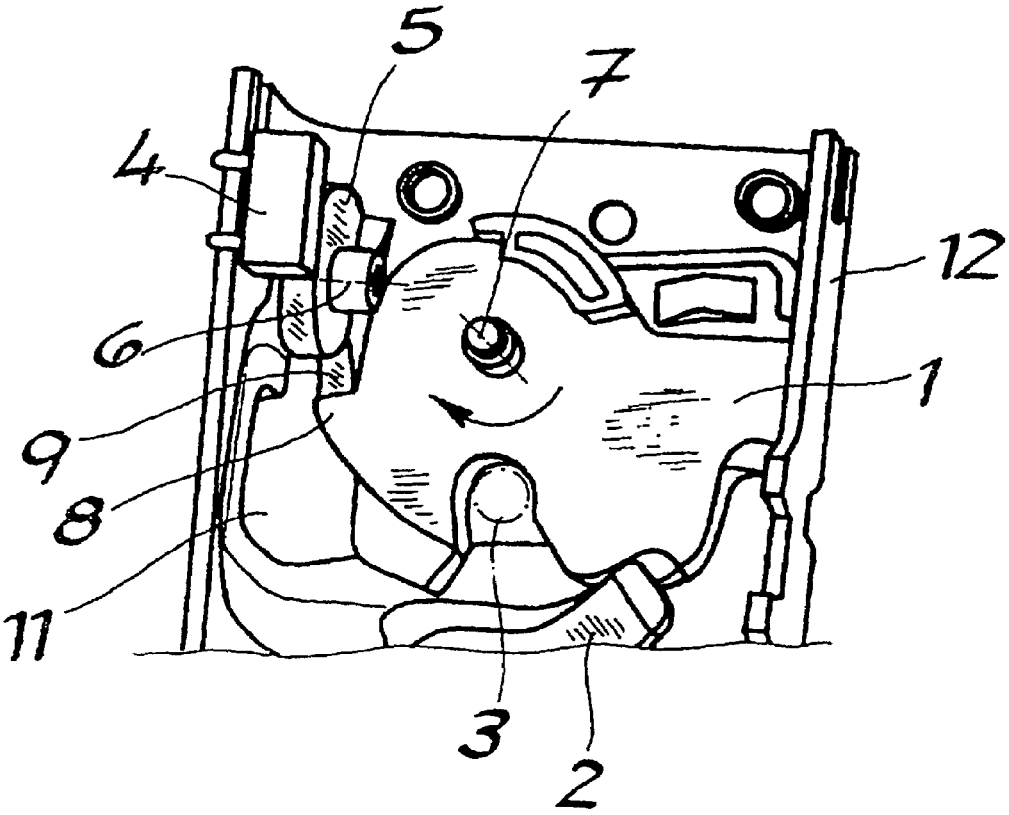
FIGS. 1 and 2 show different views of the vehicle door latch according to the invention.

The invention described herein provides a vehicle door latch with a locking mechanism (1, 2) consisting mainly of a catch (1) and pawl (2) and containing a blocking element (17) for a locking lever (18), in which the blocking element (17), with the catch (1) opened, prevents the locking lever (18) from taking up its locking position, characterized in that the blocking element (17) is designed as a non-slam lock (17) controlled by the catch (1), which, with the locking lever (18) in unlocking position, engages into in a recess (20) of the locking lever (18) in order to block said lever.

In certain embodiments of the invention described herein, the blocking element (17) is designed as a mainly linearly moveable sliding lever (17).

In certain embodiments of the invention described herein, the blocking element (17) is connected to an intermediate element (5) acted upon by the catch (1) and together forming a crank mechanism (5, 17).

In certain embodiments of the invention described herein, the blocking element (17) contains a front projection (19) engaging into the recess (20).

In certain embodiments of the invention described herein, the blocking element (17) contains a stop (21) for limiting its travel in case of the projection (19) moving into the recess (20).

In certain embodiments of the invention described herein, the blocking element (17) is rotatably connected to the intermediate element (5) designed as a catch-detecting lever (5).

In certain embodiments of the invention described herein, the blocking element (17) is guided on an insert (13).

In certain embodiments of the invention described herein, the blocking element (17) contains a recess (22) for a bearing journal (23) of the intermediate element (5).

In certain embodiments of the invention described herein, the blocking element (17) can be moved to and fro between a retracted end position, releasing the locking lever (18), and an advanced end position, blocking the locking lever (18).

In certain embodiments of the invention described herein, the two end positions are defined by the recess (22) on one and the stop (21) of the blocking element (17) on the other hand.

DETAILED DESCRIPTION OF THE INVENTION

The invention is based on the technical problem of further developing a vehicle door latch of the above embodiment in such a way that it is prevented in a simple manner that the locking lever assumes it locking position.

To solve this task, the invention suggests a vehicle door latch of the above type in which the blocking element is designed as a non-slam lock controlled by the catch, which, with the locking lever being in the unlocking position, engages into a recess of the locking lever in order to block it.

In contrast to DE 102 40 003, the non-slam lock of the invention or the blocking element also actively engages into the recess of the locking lever. A mutual stopping and blocking of the non-slam lock and the locking lever does therefore not take place. This ensures under all circumstances that the locking lever retains its unlocking position as long as the non-slam lock or the blocking element engages into the recess of the locking levers in order to block it. Only once the non-slam lock leaves the respective recess, is the locking lever able to move, for instance, into the locking position.

In detail, the non-slam lock consists mainly of a linearly moveable sliding lever that may be connected to an intermediate element acted upon by the catch. Together, the linearly moveable sliding lever and the intermediate element, representing generally an intermediate lever rotatable around an axis, form a crank mechanism.

This crank mechanism is acted upon by a catch so that the non-slam lock or the sliding lever caries out the described linear movement in order to lock the locking lever in its unlocking position, when required. For this purpose, the non-slam lock generally contains a front projection engaging into the recess. In addition, it may contain a front stop for limiting its travel, which becomes effective when the projection has moved into the recess. This means that the above stop ensures that the blocking movement of the sliding lever or of the non-slam lock is limited, in particular when the stop is moved against the non-slam lock when the projection has moved into the recess.

In order to facilitate the linear movement of the non-slam lock or of the sliding lever, the non-slam lock is usually guided on an insert or inlet insert. This inlet insert is inserted into a housing or the back plate of the vehicle door latch and ensures the correct guiding of the locking pin when moved towards and away from the catch. The inlet insert can be designed as a plastic insert opened in the direction of the catch, containing a guide face in the area of the non-slam lock.

In addition to the stop, the non-slam lock also contains a recess for a bearing journal of the intermediate element. The stop as well as the recess define the respective end positions of the non-slam lock and limit these. As the non-slam lock can be moved to and fro between the retracted end position, releasing the locking lever and the advanced end position, blocking the locking lever. At the same time, the recess defines the retracted position releasing the locking lever, whilst the stop corresponds with the advanced end position of the non-slam lock, blocking the locking lever.

As a result, a vehicle door latch is provided that contains a blocking element or a non-slam lock, holding the locking lever and thus the entire locking lever mechanism reliably in the unlocking position, provided the catch is in its open position. Only when the catch is closed, is the locking lever released and can thus assume its "locked" position. These are the main advantages of the invention.

The figures show a vehicle door latch, whose standard design includes a locking mechanism 1, 2 consisting of the catch 1 and pawl 2. The locking mechanism 1, 2 interacts with a locking pin 3, only indicated in FIG. 1, in the usual manner. In order to be able to detect the position of the catch 1, a sensor 4 is provided, which in the embodiment is designed as a micro switch 4.

Between the sensor or micro switch 4 the catch 1 to be detected, an intermediate element 5 is located, transferring the movement of the catch 1 onto the sensor 4. The intermediate element 5 in the embodiment is designed as an intermediate lever 5 with a mainly circular to oval overall shape. Generally, naturally any intermediate elements 5 that are able to transfer the rotary movement of the catch 1 onto the sensor or micro switch 4 can be used. It would, for instance, be possible to use regulating rods, toothed gears, frictional wheels, Bowden cables, etc. The intermediate lever 5 shown in the embodiment represents, however, the lowest design cost.

Figure 2:
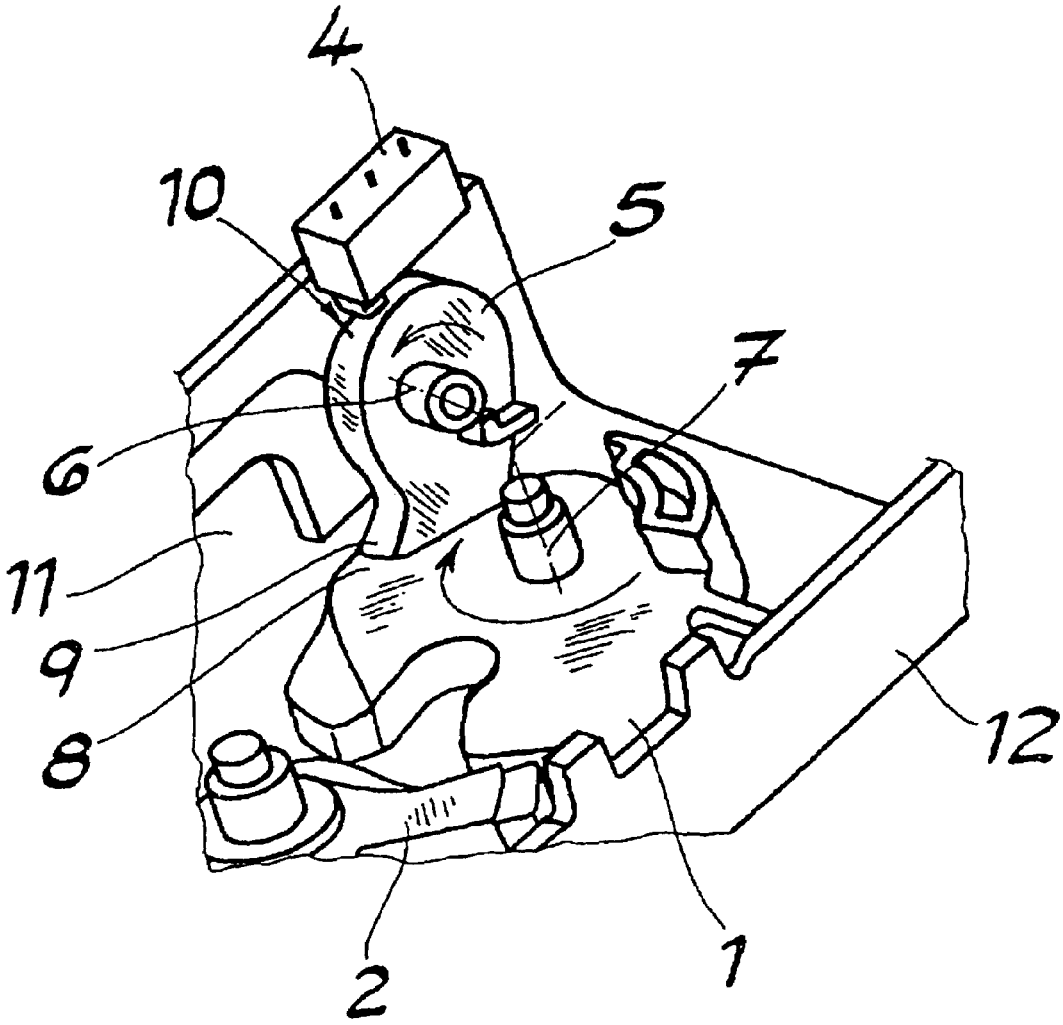

The intermediate element or the intermediate lever 5 is rotatably arranged around an axis 6. The catch 1, in contrast, contains a predominantly vertically arranged axis 7. As a result of the angled arrangement of the two axes 6, 7, the intermediate element or the intermediate lever 5 are only moved by the catch 1 within a limited angle of rotation in order to trigger the sensor or micro switch 4. In general, the described movement only occurs, when the catch 1 moves out of the primary position shown in FIGS. 1 and 2. For this purpose, the pawl 2 may be lifted out (mechanically or by a motor) so that the catch 1 carries out a clockwise rotation indicated by an arrow in FIG. 2.

As a result, a projection 8 on the catch 1 engages into an extension arm 9 on the intermediate element or intermediate lever 5, so that the catch 1, rotating clockwise, rotates the intermediate lever 5 in its front view around axis 6 in the indicated anti-clockwise direction. Consequently, a detection profile 10 on the intermediate lever 5 for sensor 4 is able to produce a signal on the output side of the sensor 4. A control system, not shown, is also informed that the catch 1 has left its primary position and carries out an opening movement.

The open position of the catch 1 results in closing movements of the catch 1 due to a relative movement between the locking pin 3 and an inlet opening 11 in clockwise rotations of the intermediate levers 5 when seen from the front. In the reference system of the vehicle door latch, the locking pin 3 moves into the inlet opening 11. In reality, this process is, of course, caused by a vehicle door with an attached vehicle door latch being moved in contrast to a vehicle body to which the locking pin is fixed.

In one way or another, this process ensures that the sensor or micro switch 4 is not activated. In principle, the movement of catch 1 or the reaching of the primary position could, of course, also be detected. As the primary aim is to detect the opening movement of catch 1.

As a result of the realized intermediate element or intermediate lever 5, the sensor or micro switch 4 can basically be arranged anywhere within a latch housing or frame box 12. The positioning along a L-leg of the frame box or latch housings 12 has proven to be advantageous. Catch 1 does thus (no longer) prescribe the position of the sensor 4.

Figure 3:
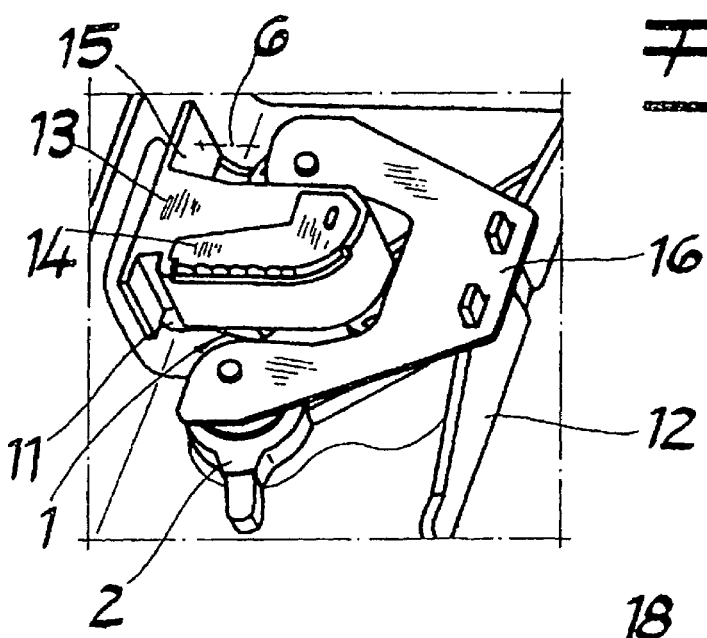
FIG. 3 shows the vehicle door latch according to FIGS. 1 and 2 with an insert for holding the intermediate element installed in the latch housing.

As part of the embodiment, the intermediate element or the intermediate lever 5 is advantageously arranged on an insert 13 for the latch housing or the frame box 12. This is, in particular, shown in FIG. 3, in which this insert 13 is apparent. The insert 13 is an inlet insert 13, i.e. an insert, defining the inlet opening 11 for the locking pin 3. The insert or the inlet insert 13 consist of a plastic molding with an integrated cushioning element 14 for the locking pin 3 and the catch 1.

This insert or inlet insert 13 contains a fixing plate 15 with an extension, accommodating a journal as axis 6, onto which the intermediate lever 5 is placed. As a result, insert 13 and intermediate lever 5 constitute a sub-assembly, which in its entirety can be connected to the latch housing or frame box 12, by, for instance, latching, riveting, bolting, gluing, etc. The intermediate element or the intermediate lever 5 can also be designed as a plastic molding. An additional reinforcement plate 16 shown in FIG. 3 ensures, amongst other things, the correct fixing of the catch 1.

Figure 4:
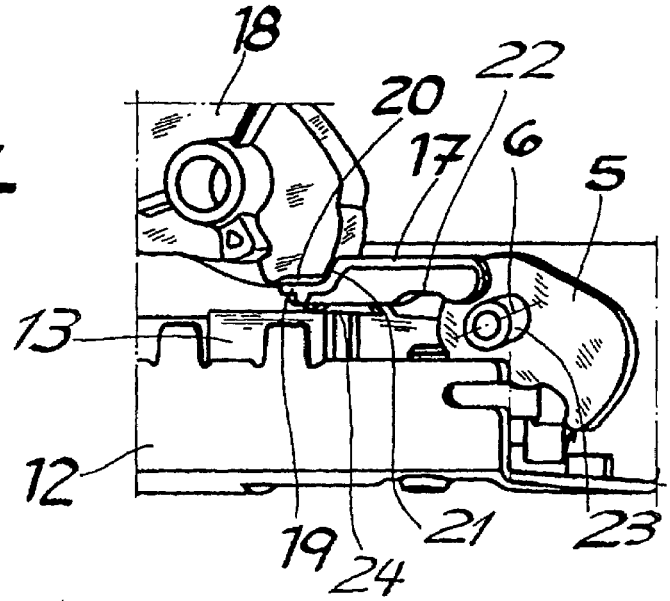
FIGS. 4 and 5 show the non-slam lock on the intermediate element with open (FIG. 4) and closed catch (FIG. 5).
Figure 5:
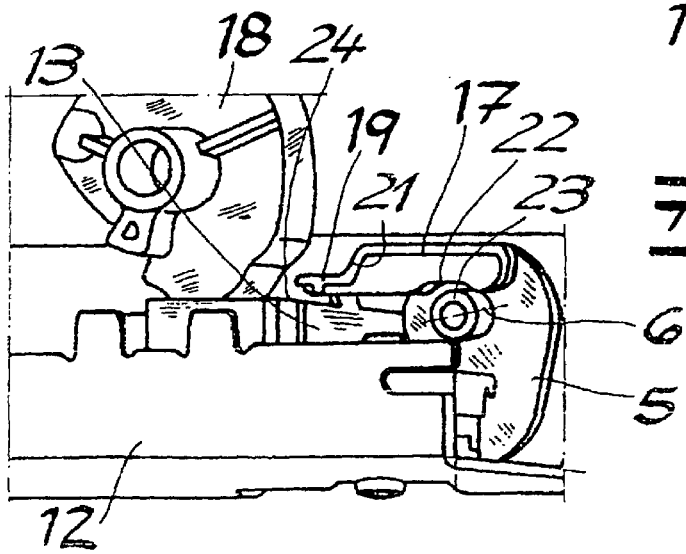

From FIGS. 4 and 5, the further function of the intermediate element 5 now becomes apparent. Said element not only transfers the rotation movement of the catch 1 onto the sensor 4 but also provides a seat for a blocking element or a non-slam lock 17. This non-slam lock 17 mechanically blocks a locking lever 18 when catch 1 is open (see FIG. 4). For this purpose, the non-slam lock 17 designed as a sliding lever 17 engages with its front projection 19 into a recess 20 of the locking levers 18.

If the catch 1 is, however, in its closed position, the non-slam lock or the sliding lever 17 is retracted from the intermediate lever 5, so that the projection 19 leaves the recess 20. The locking lever 18 has now been released.

The figure shows that the blocking element or the sliding lever 17 forms a crank mechanism together with the intermediate element or the intermediate lever 5, whose movement is stopped by a front stop 21. This applies, when the non-slam lock or the sliding lever 17 is moved into the advanced end position blocking the locking lever 18. In this case, the stop 21 rests against the respective locking lever 18 and consequently, the travel of the non-slam lock or of the sliding lever 17 is limited if the projection 19 has moved into recess 20.

The non-slam lock or the sliding lever 17 also contains a recess 22 for a bearing journal 23 of the intermediate element or of the intermediate lever 5. With the aid of this recess 22 and the bearing journals 23, a further end position of the non-slam lock 17 is defined, i.e. the retracted position, releasing the locking lever 18. Both end positions are shown in FIGS. 4 and 5.

The sliding lever 17 moves to and fro between these positions and that in a linear motion. The inlet insert or insert 13 with a respective guide face 24 contributes to guiding said lever. In other words, the rotary movements of the catch 1 are, first of all transformed onto a different level by the intermediate lever 5 and are then converted into the said linear movements along insert 13 or its face 24 with the aid of the rotatably connected sliding lever 17 and the crank mechanism realized between the intermediate lever 5 and the sliding lever 17. The sliding lever 17 can be connected to the intermediate lever 5 by riveting the sliding lever 17 to the intermediate lever 5 or clipping it onto the intermediate lever 5. Similarly, all other levers can be connected to each other by riveting or clipping. In case of a steel embodiment, also an adhesion connection, in form of welding, is possible, where for instance a flexible connection is not required.

The invention claimed is:

1. A vehicle door latch with a locking mechanism (1, 2) comprising a catch (1) having a first axis of rotation (7) and being movable between an open position and a closed position;

a pawl (2);

an intermediate element (5) abutting said catch (1) and having a second axis of rotation (6);

a blocking element (17); and a locking lever (18) having a first recess (20) for engaging said blocking element (17) and being movable between a locking position and an unlocking position;

wherein said blocking element (17) is connected to said intermediate element (5); said blocking element (17) and said intermediate element (5) taken together form a crank mechanism;

if said catch (1) is in said open position, said blocking element (17) is in said unlocking position and said blocking element (17) prevents said locking lever (18) from being moved to said locking position;

said blocking element (17) comprises a front projection (19) for engaging into said first recess (20); and said blocking element (17) comprises further a stop (21), said stop (21) limiting movement of said projection (19) within said first recess (20).

2. The vehicle door latch of claim 1, wherein said blocking element (17) is linearly moveable.

3. The vehicle door latch of claim 1, wherein if said locking lever (18) is in said unlocking position, said blocking element (17) engages into said first recess (20) in order to block said locking lever (18) from being moved to said locking position.

4. The vehicle door latch of claim 1, wherein said blocking element (17) is rotatably connected to said intermediate element (5).

5. The vehicle door latch of claim 1 comprising further a latch housing (12) having an inlet opening (11) for receiving a locking pin (3), and an inlet insert (13) having a guide face (24) disposed within said inlet opening (11), wherein said blocking element (17) is linearly movable along said guide face (24).

6. The vehicle door latch of claim 5, wherein said inlet insert (13) is made of molded plastic.

7. The vehicle door latch of claim 5, wherein said inlet insert (13) and said intermediate element (5) create a subassembly.

8. The vehicle door latch of claim 7, wherein said subassembly is connected to said latch housing (12) by latching, riveting, bolting, or gluing.

9. The vehicle door latch of claim 1, wherein said blocking element (17) comprises further a stop (21), said stop (21) limiting movement of said blocking element (17) in an advanced end position.

10. The vehicle door latch of claim 1, wherein said intermediate element (5) is made of molded plastic.

11. A vehicle door latch with a locking mechanism (1, 2) comprising a catch (1) having a first axis of rotation (7) and being movable between an open position and a closed position;

a pawl (2);

an intermediate element (5) abutting said catch (1) and having a second axis of rotation (6);

a blocking element (17); and a locking lever (18) having a first recess (20) for engaging said blocking element (17) and being movable between a locking position and an unlocking position;

wherein said blocking element (17) is connected to said intermediate element (5); said blocking element (17) and said intermediate element (5) taken together form a crank mechanism;

if said catch (1) is in said open position, said blocking element (17) is in said unlocking position and said blocking element (17) prevents said locking lever (18) from being moved to said locking position;

said intermediate element (5) comprises further a bearing journal (23), and said blocking element (17) comprises further a second recess (22), said bearing journal (23) and said second recess (22) limiting movement of said blocking element (17) in a retracted position.

12. The vehicle door latch of claim 11, wherein said blocking element (17) is movable between said advanced end position and said retracted position, wherein if said blocking element (17) is in said advanced end position, said locking lever (18) is blocked from being moved to said locking position; and if said blocking element (17) is in said retracted position, said locking lever (18) is not blocked from being moved to said locking position.

13. The vehicle door latch of claim 12, wherein said locking lever (18) is not blocked from being moved to said locking position if and only if said blocking element (17) is in said retracted position.

14. The vehicle door latch of claim 12, wherein said locking lever (18) is not blocked from being moved to said locking position if and only if said catch (1) is in said closed position.

15. The vehicle door latch of claim 11, wherein said advanced end position and said retracted position are end positions.

16. A vehicle door latch with a locking mechanism (1, 2) comprising a catch (1) having a first axis of rotation (7) and being movable between an open position and a closed position;

a pawl (2);

an intermediate element (5) abutting said catch (1) and having a second axis of rotation (6);

a blocking element (17); and a locking lever (18) having a first recess (20) for engaging said blocking element (17) and being movable between a locking position and an unlocking position;

wherein said blocking element (17) is connected to said intermediate element (5); said blocking element (17) and said intermediate element (5) taken together form a crank mechanism;

if said catch (1) is in said open position, said blocking element (17) is in said unlocking position and said blocking element (17) prevents said locking lever (18) from being moved to said locking position; and said blocking element (17) is riveted or clipped to said intermediate element (5).

17. A vehicle door latch with a locking mechanism (1, 2) comprising a catch (1) having a first axis of rotation (7) and being movable between an open position and a closed position;

a pawl (2);

an intermediate element (5) abutting said catch (1) and having a second axis of rotation (6);

a blocking element (17); and a locking lever (18) having a first recess (20) for engaging said blocking element (17) and being movable between a locking position and an unlocking position;

wherein said blocking element (17) is connected to said intermediate element (5); said blocking element (17) and said intermediate element (5) taken together form a crank mechanism;

if said catch (1) is in said open position, said blocking element (17) is in said unlocking position and said blocking element (17) prevents said locking lever (18) from being moved to said locking position; and said blocking element (17) is welded to said intermediate element (5).

* * * * *